US012435533B2

(12) United States Patent
Cohen et al.

(10) Patent No.: US 12,435,533 B2
(45) Date of Patent: Oct. 7, 2025

(54) CONSTRUCTION SYSTEM

(71) Applicant: Wall to Wall, LLC, Hayward, CA (US)

(72) Inventors: Yaniv Cohen, Givat Ela (IL); Ziv Raz, Even Yehuda (IL); Brad Cameron, Fountain Hills, AZ (US); Daniel Kedem, Tel Aviv-Jaffa (IL)

(73) Assignee: Wall to Wall, LLC, Hayward, CA (US)

( * ) Notice: Subject to any disclaimer, the term of this patent is extended or adjusted under 35 U.S.C. 154(b) by 249 days.

(21) Appl. No.: 18/069,501

(22) Filed: Dec. 21, 2022

(65) Prior Publication Data

US 2023/0212870 A1 Jul. 6, 2023

(30) Foreign Application Priority Data

Dec. 30, 2021 (IL) ..... 289522

(51) Int. Cl.
*E04H 9/02* (2006.01)

(52) U.S. Cl.
CPC ..... *E04H 9/021* (2013.01); *E04H 9/024* (2013.01)

(58) Field of Classification Search
CPC . E04H 9/024; E04H 9/021; E04C 3/16; E04C 3/02
USPC ..... 52/167.1
See application file for complete search history.

(56) References Cited

U.S. PATENT DOCUMENTS 3,067,544 A * 12/1962 Willatts ..... E04C 3/17 52/642
4,187,652 A * 2/1980 Bobrovnikov ..... E04B 1/24 52/643
4,648,216 A * 3/1987 Reaves ..... E04C 3/17 52/693
5,218,804 A * 6/1993 Campbell ..... E06B 3/26336 52/262
6,158,189 A * 12/2000 Lau ..... E04C 3/145 52/693
7,549,263 B1 * 6/2009 Porter ..... E04B 1/14 52/794.1
7,779,590 B2 8/2010 Hsu et al.
7,849,649 B2 * 12/2010 Tonyan ..... B32B 13/02 106/735
2002/0007611 A1 * 1/2002 Sanford ..... E04C 3/16 52/694
2009/0272051 A1 * 11/2009 Sipe ..... E04B 1/08 52/483.1

(Continued)

OTHER PUBLICATIONS

ALL-FAB (Year: 2021).*
Office Action and Search Report dated May 12, 2024, directed to IL Application No. 289522; 8 pages.

*Primary Examiner* — Paola Agudelo
(74) *Attorney, Agent, or Firm* — Morrison & Foerster LLP

(57) ABSTRACT

A modular construction system comprising: a first prefabricated building component including: a first plurality of support members extending parallel to each other in a first direction; and a first lateral force collector configured to transfer lateral forces; a second prefabricated building component including: a second plurality of support members extending parallel to each other in a second direction; and a second lateral force collector configured to transfer the lateral forces; and a connector extending between the first lateral force collector and the second lateral force collector configured to transfer the lateral forces therebetween.

33 Claims, 20 Drawing Sheets

(56) References Cited

U.S. PATENT DOCUMENTS

| | | | | |
|---|---|---|---|---|
| 2010/0180540 | A1* | 7/2010 | Shepard | E04B 1/18 52/745.05 |
| 2014/0260024 | A1* | 9/2014 | Tate | E04C 3/40 52/693 |
| 2015/0167289 | A1 | 6/2015 | Wang | |
| 2015/0211229 | A1* | 7/2015 | Gosling | E04C 2/405 52/745.02 |
| 2016/0024779 | A1* | 1/2016 | Clus | E04B 2/706 52/79.1 |
| 2016/0053488 | A1* | 2/2016 | Lehane | E04B 9/067 52/506.07 |
| 2017/0197811 | A1* | 7/2017 | Cui | B66C 1/66 |
| 2018/0305925 | A1* | 10/2018 | Cecchetto, Jr. | E04B 2/90 |
| 2018/0328034 | A1* | 11/2018 | Cecchetto, Jr. | E04B 7/20 |
| 2018/0355603 | A1* | 12/2018 | Hall | E04B 1/14 |
| 2019/0242112 | A1* | 8/2019 | LeBlang | E04B 1/2403 |
| 2022/0025663 | A1* | 1/2022 | Heitsman | E04B 1/34838 |
| 2022/0145632 | A1* | 5/2022 | Aitken | E04C 3/42 |
| 2022/0389709 | A1* | 12/2022 | LeBlang | E04B 2/58 |

* cited by examiner

CONSTRUCTION SYSTEM

TECHNICAL FIELD

The present disclosure relates to a construction system, and in particular to a construction system including modular components with interconnected lateral force collectors.

BACKGROUND

Modular construction is a process in which a building is constructed off-site, under controlled plant conditions, using the same materials and designing to the same codes and standards as conventionally built facilities, but in a much reduced time effort, typically half the time. Buildings are produced in "modules" or "components" that when put together on site, reflect the identical design intent and specifications of the most sophisticated site-built facility without compromise.

Buildings that are subjected to lateral forces, e.g. caused by natural phenomenon, such as wind or earthquakes, may need shear walls as part of a lateral force resisting system. A shear wall is a structural panel that can resist lateral forces, i.e. forces that are parallel to the plane of the wall, to prevent damage to the building's components.

An object of the present disclosure is to overcome the shortcomings of the prior art and provide modular building components that include shear force collectors that may be easily connected to enable lateral forces to be transferred between modular building components and the shear wall.

GENERAL DESCRIPTION

According to a first aspect of the presently disclosed subject matter, there is provided a modular construction system comprising:

- a first prefabricated building component including:
  - a first plurality of support members extending parallel to each other in a first direction; and
  - a first lateral force collector configured to transfer lateral forces;
- a second prefabricated building component including:
  - a second plurality of support members extending parallel to each other in a second direction; and
  - a second lateral force collector configured to transfer the lateral forces; and
- a connector extending between the first lateral force collector and the second lateral force collector configured to transfer the lateral forces therebetween.

The first and second prefabricated building components may be ceiling components, floor components, roof components, or wall components, in particular shear wall components.

The first and second prefabricated building components of the presently disclosed subject matter can be provided as closed components, i.e., with minimal access to their interior due to coverings attached thereto. The first and second prefabricated building components can also have various configurations of their support members, but irrespectively of that, their force collectors are connectable to each other via the connector, to provide a continuous force collector for transferring later forces along an entire structure of a building, to properly absorb these forces with minimal risk to the building and its infrastructure.

The modular construction system may also include that the first lateral force collector and the second lateral force collector are colinear.

The modular construction system may also include that the first lateral force collector and the second lateral force collector extend along parallel axes.

In any of the above embodiments, the modular construction system may also include that the first plurality of support members comprises a first plurality of trusses, each of the plurality of trusses including a first top chord, a first bottom chord, and first web members extending therebetween; and wherein the first lateral force collector extends perpendicular to the first plurality of trusses, and is mounted on top of the first bottom chords of the first plurality of trusses.

In any of the above embodiments, the modular construction system may also include that the first lateral force collector includes a first extender extending down to a level even with a bottom of the first bottom chord.

In any of the above embodiments, the modular construction system may also include that each of the second plurality of trusses including a second top chord, a second bottom chord, and second web members extending therebetween; and wherein the second lateral force collector extends perpendicular to the second plurality of trusses, and is mounted on top of the second bottom chords of the second plurality of trusses.

In any of the above embodiments, the modular construction system may also include that the second lateral force collector includes a second extender extending down to a level even with a bottom of the second bottom chord.

In any of the above embodiments, the modular construction system may also include that the connector extends between the first extender and the second extender.

In any of the above embodiments, the modular construction system may also include that the connector is configured to connect the first extender and the second extender along bottom surfaces of the first and second extenders.

In any of the above embodiments, the modular construction system may also include that the second lateral force collector extends parallel to the second plurality of support members.

In any of the above embodiments, the modular construction system may also include that the second plurality of support members comprises a second plurality of trusses, wherein each of the second plurality of trusses including a second top chord, a second bottom chord, and second web members extending therebetween; and wherein the second lateral force collector comprises one of the second bottom chords.

In any of the above embodiments, the modular construction system may also include that the first lateral force collector extends parallel to the first plurality of support members.

In any of the above embodiments, the modular construction system may also include that the first plurality of support members comprises a first plurality of trusses, wherein each of the first plurality of trusses including a first top chord, a first bottom chord, and first web members extending therebetween; and wherein the first lateral force collector comprises one of the first bottom chords.

In any of the above embodiments, the modular construction system may also include that the first lateral force collector extends out one side of the first floor component; and wherein the second lateral force collector extends out one side of the second floor component; and wherein the connector includes a first mating connector on the first lateral force collector, and a second mating connector on the second lateral force collector configured to interconnect with the first mating connector.

In any of the above embodiments, the modular construction system may also include a first wall;

wherein the connector comprises:

a first wall mounting member configured to mount on a first side of the first wall and configured to receive a first end of the first lateral force collector;

a second wall mounting member configured to mount on a second side of the first wall configured to be to receive a first end of the second lateral force collector; and a wall collector configured to mount in the first wall and connected to the first wall mounting member and the second wall mounting member.

In any of the above embodiments, the modular construction system may also include a second wall; and a first L-bracket mounted on a first side of the second wall configured to receive ends of the first plurality of support members or one of the first plurality of support members.

In any of the above embodiments, the modular construction system may also include a first bottom layer on the first plurality of support members, and a first top layer of mounted on the first plurality of support members.

In any of the above embodiments, the modular construction system may also include that the first bottom layer comprises drywall.

In any of the above embodiments, the modular construction system may also include that the first top layer comprises concrete.

In any of the above embodiments, the modular construction system may also include a second bottom layer on the second plurality of support members, and a second top layer of mounted on the second plurality of support members.

In any of the above embodiments, the modular construction system may also include that the second bottom layer comprises drywall.

In any of the above embodiments, the modular construction system may also include that the second top layer comprises concrete.

In any of the above embodiments, the modular construction system may also include first bridging members extending between adjacent ones of the first plurality of support members, the first lateral force collector and the first top layer.

In any of the above embodiments, the modular construction system may also include that the first prefabricated building component or the second prefabricated building component comprises a shear wall.

According to another aspect of the presently disclosed subject matter, there is provided a modular construction system comprising:

a first prefabricated building component including:

a first plurality of support members extending parallel to each other in a first direction; and a first lateral force collector configured to transfer lateral forces.

The first prefabricated building component may be a ceiling component, a floor component, a roof component, or a wall component.

The first prefabricated building component of the presently disclosed subject matter can be provided as closed component, i.e., with minimal access to its interior due to coverings attached thereto. The first prefabricated building component can also have various configurations of its support members, but irrespectively of that, its force collectors is connectable to a later force collector of another building component via a connector, to provide a continuous force collector for transferring later forces along an entire structure of a building, to properly absorb these forces with minimal risk to the building and its infrastructure.

Accordingly, modular construction system may include a connector connected to the first lateral force collector, and configured to connect the first lateral force collector to a second lateral force collector for transferring the lateral forces therebetween.

In any of the above embodiments the construction system may also include that the first plurality of support members comprises a first plurality of trusses, wherein each of the first plurality of trusses including a first top chord, a first bottom chord, and first web members extending therebetween; and wherein the first lateral force collector extends perpendicular to the first plurality of trusses, and is mounted on top of the first bottom chords of the first plurality of trusses.

In any of the above embodiments the construction system may also include that the first lateral force collector includes a first extender extending down to a level even with a bottom of the first bottom chord.

In any of the above embodiments the construction system may also include that the connector is configured to connect the first extender to a second extender in an adjacent floor component along bottom surfaces of the first and second extenders.

In any of the above embodiments the construction system may also include that the first plurality of support members comprises a first plurality of trusses, wherein each of the first plurality of trusses including a first top chord, a first bottom chord, and first web members extending therebetween; and wherein the first lateral force collector extends parallel to the first plurality of trusses.

In any of the above embodiments the construction system may also include that the first lateral force collector comprises one of the first bottom chords.

In any of the above embodiments the construction system may also include that the first lateral force collector extends out one side of the first building components; and wherein the connector includes a first mating connector on the first lateral force collector configured to mate with a second mating connector on the second lateral force collector.

In any of the above embodiments the construction system may also include a first wall;

wherein the connector comprises:

a first wall mounting member configured to mount on a first side of the first wall and configured to receive a first end of the first lateral force collector;

a second wall mounting member configured to mount on a second side of the first wall configured to be to receive a first end of the second lateral force collector; and a wall collector configured to mount in the first wall and connected to the first wall mounting member and the second wall mounting member.

In any of the above embodiments the construction system may also include a first L-bracket for mounting on a first side of a second wall configured to receive ends of the first plurality of support members.

In any of the above embodiments the construction system may also include a first bottom layer on the first plurality of support members, and a first top layer of mounted on the first plurality of support members.

In any of the above embodiments the construction system may also include that the first bottom layer comprises drywall.

In any of the above embodiments the construction system may also include that the first top layer comprises one or more of concrete, insulation, RPG, PV cells.

In any of the above embodiments the construction system may also include a shear wall connected to the first lateral force collector.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION

While the present teachings are described in conjunction with various embodiments and examples, it is not intended that the present teachings be limited to such embodiments. On the contrary, the present teachings encompass various alternatives and equivalents, as will be appreciated by those of skill in the art.

Figure 1:
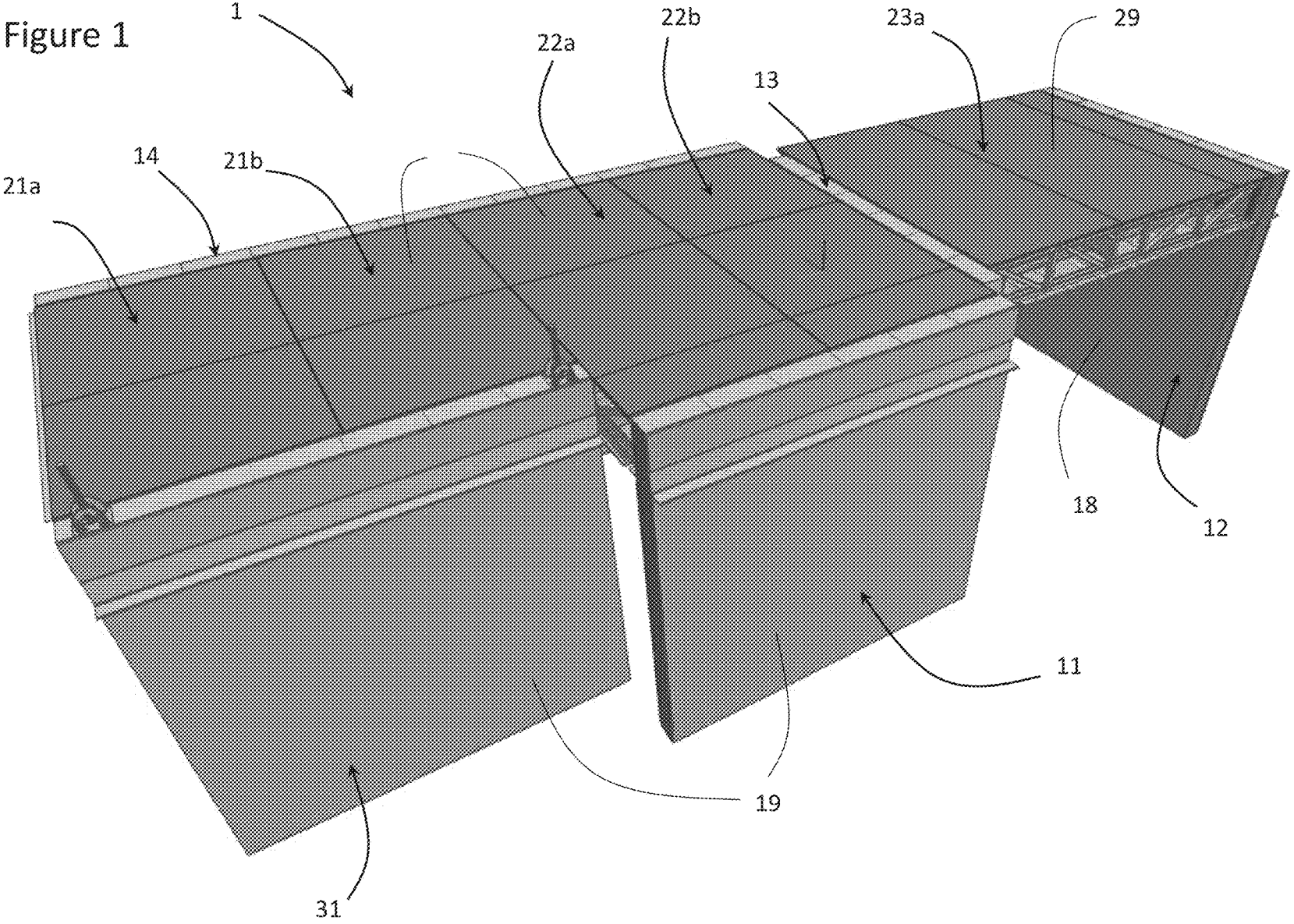
FIG. 1 is an isometric view of an exemplary prefabricated modular building system.
Figure 2:
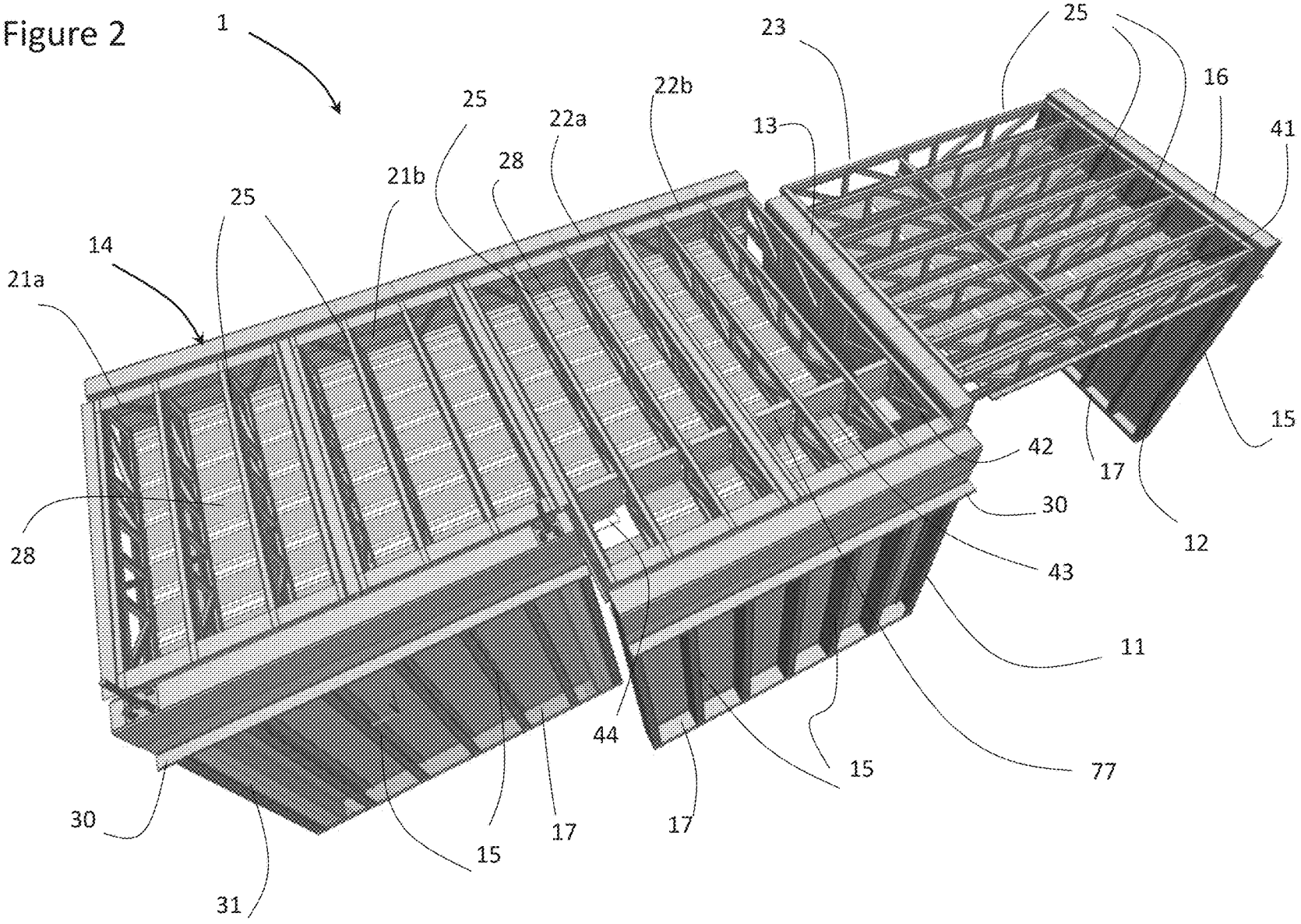
FIG. 2 is an isometric view of the exemplary prefabricated modular building system of FIG. 1 with the wall coverings removed.
Figure 3:
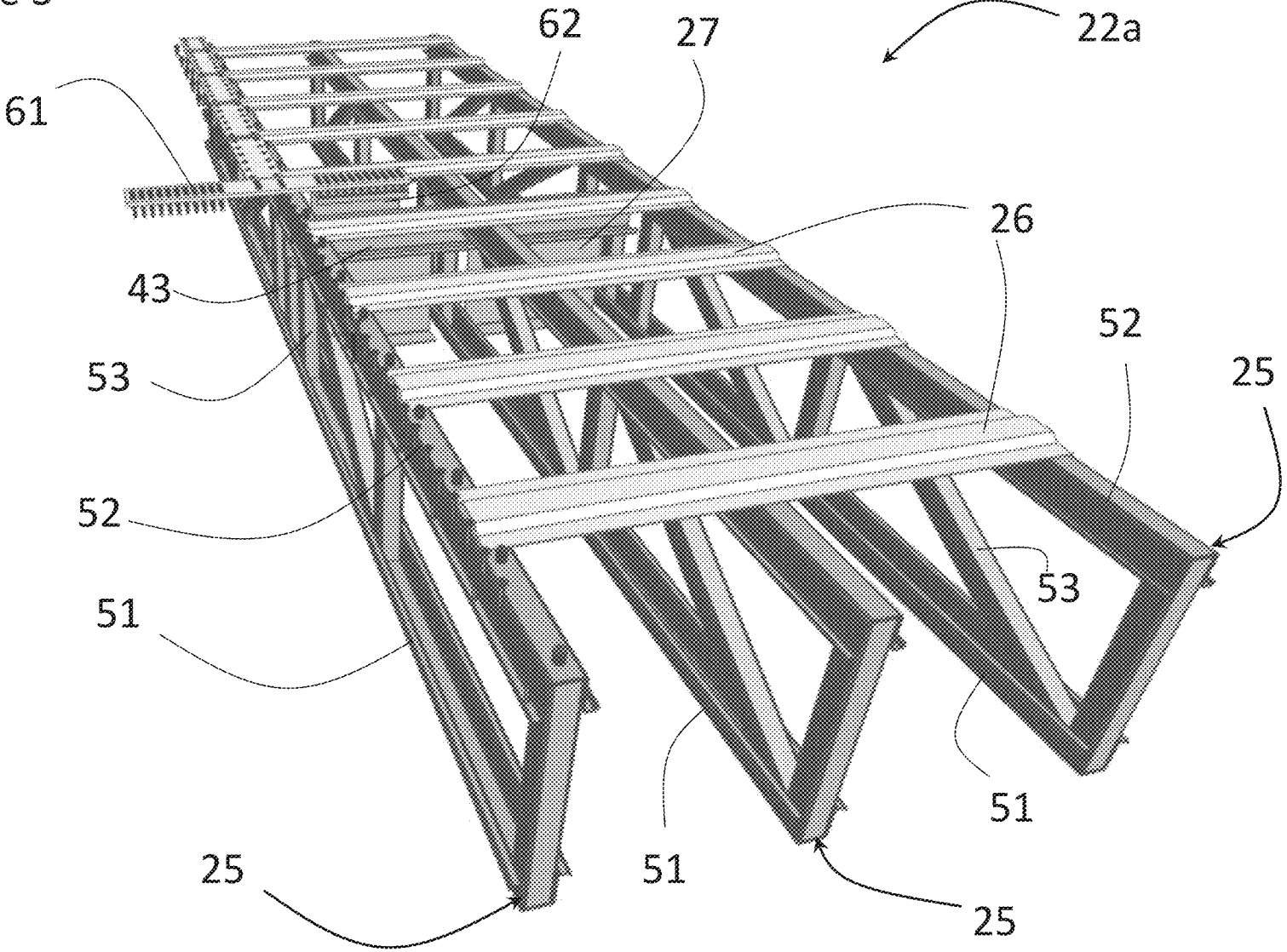
FIG. 3 is an isometric view of a building component of the exemplary prefabricated modular building system of FIG. 1 with the wall coverings removed.
Figure 4:
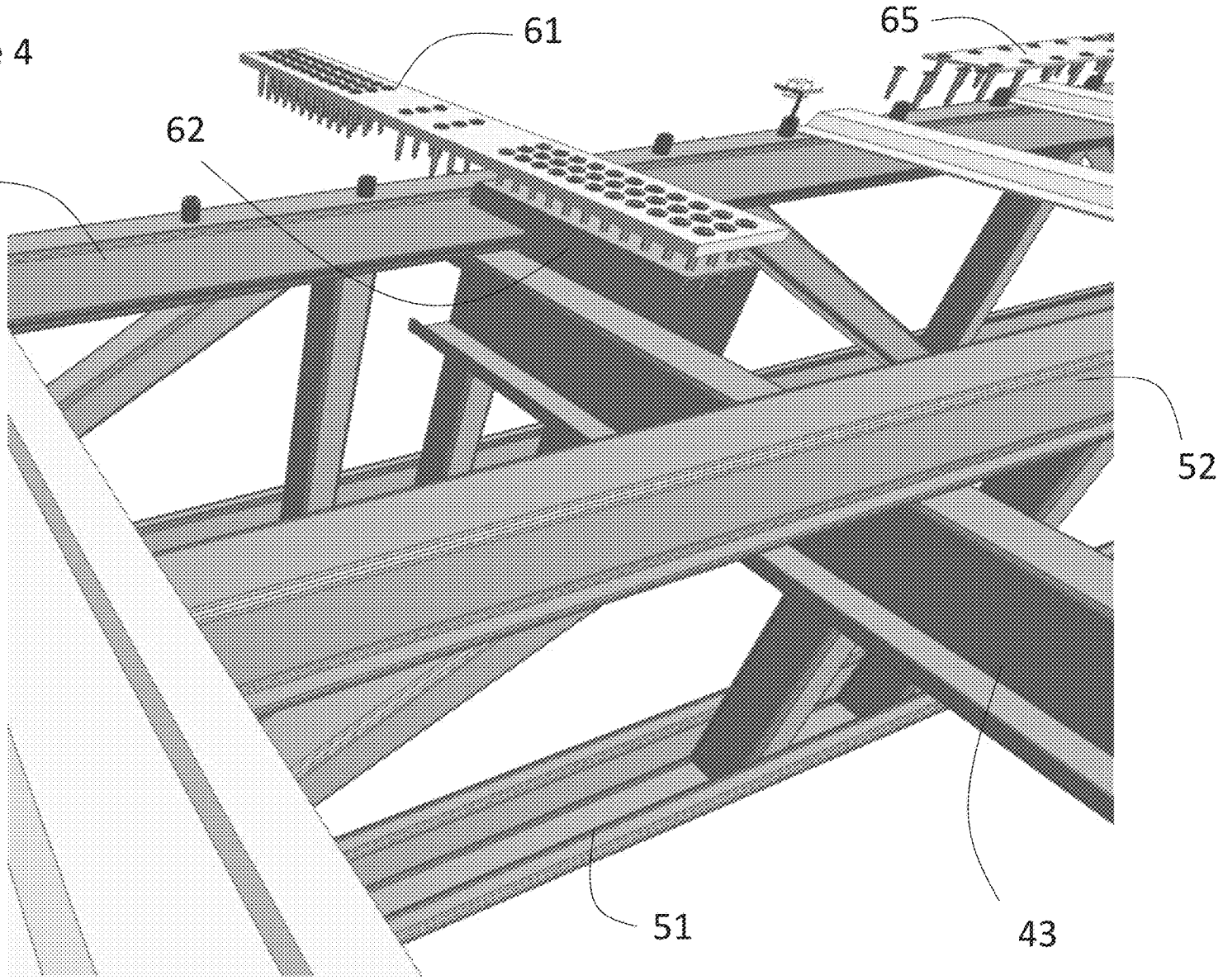
FIG. 4 is an enlarged isometric view of a component connector of the building component of the exemplary prefabricated modular building system of FIG. 1 with the wall coverings removed.

With reference to FIGS. 1 and 2, an example modular building system 1, may comprise a plurality of prefabricated building components including a plurality of prefabricated vertical wall components 11, 12, 13 and 14, a plurality of prefabricated ceiling/floor components 21*a*, 21*b*, 22*a*, 22*b* and 23, and at least one prefabricated shear wall component 31. Each of the wall components 11 and 12, and the shear wall component 31 may include a plurality of support members 15, e.g. studs, a top plate 16 and a bottom plate 17. The front and back of each wall component may also include a suitable inside covering 18 and outside covering 19, for example drywall for the inside covering 18 and siding as the outside covering 19. Each of the ceiling/floor components 21*a*, 21*b*, 22*a*, 22*b* and 23 may include a plurality of support members 25, e.g. beams, joists or trusses, fixed together with top lateral bridging 26 and/or internal lateral bridging 27 extending therebetween. The top and bottom of each ceiling/floor component may include a suitable inside covering 28 and outside covering 29, for example drywall as the inside covering 29 and plywood sheeting or cement as the outside covering. The outside covering 29 may depend on the final use of the ceiling/floor component, e.g. when the ceiling/floor component is a ceiling component, the outer covering 29 may include shingles, tin, photovoltaic cells etc. The ceiling/floor components 21*a*, 21*b*, 22*a*, 22*b* and 23 may be mounted on the wall components 11, 12, 13, 14 and 31 utilizing L-brackets 30 fixed to the wall components 11, 12, 13, 14 and 31, e.g. perpendicular to the support members 15.

A plurality of building components, e.g. ceiling/floor component 22*a* and 22*b*, may be connected together in a same room to form a uniform wall or ceiling, and in a same building to form a composite wall or ceiling. In order for lateral forces, e.g. caused by natural phenomenon, such as wind or earthquakes, to be transferred from each of the wall components, e.g. wall components 11, 12, 13 and 14, and each of the ceiling/floor components 21*a*, 21*b*, 22*a*, 22*b* and 23, to the one or more shear walls, e.g. shear wall component 31, lateral force collectors may be provided in each of the building components. The lateral force collectors may include a parallel lateral force collectors 41, a wall lateral force connector 42, perpendicular lateral force collectors 43, and a wall lateral force collector 44, as hereinafter described in greater detail. The lateral force collectors, e.g. lateral force collectors 41, 42, 43 and 44, may be aligned collinearly or one or more of the lateral force collectors may be at angle thereto. The lateral force collectors may extend along parallel axes with an additional shunt lateral force collector therebetween.

With reference to FIGS. 3-8, the ceiling/floor component 22*a* may include a plurality of support members 25, e.g. beams, joists or trusses, fixed together with the top lateral bridging 26 and/or the internal lateral bridging 27 extending therebetween. In the illustrated example, each support member 25 comprises a ceiling truss including a top chord 51, a bottom chord 52 and a web 53 extending therebetween. The perpendicular lateral force collector 43 extends across, e.g. perpendicular to, the support members 25, mounted on a top surface of the bottom chord 52. The perpendicular lateral force collector 43 may comprise any suitable structural element for transferring lateral forces, e.g. a steel L-beam or C-beam.

Figure 5:
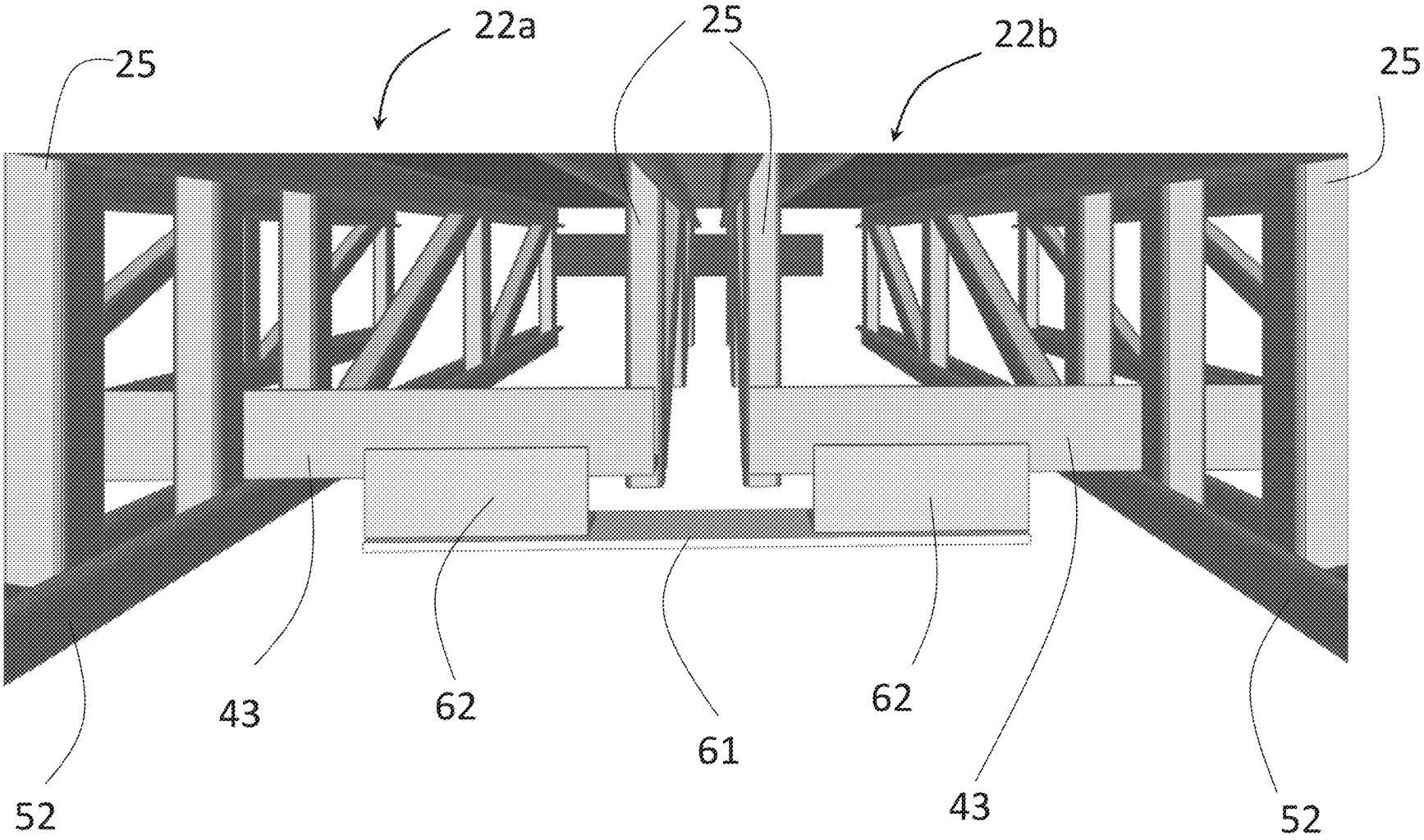
FIG. 5 is a side view of the component connector of FIG. 4 connected to a second building component.
Figure 6:
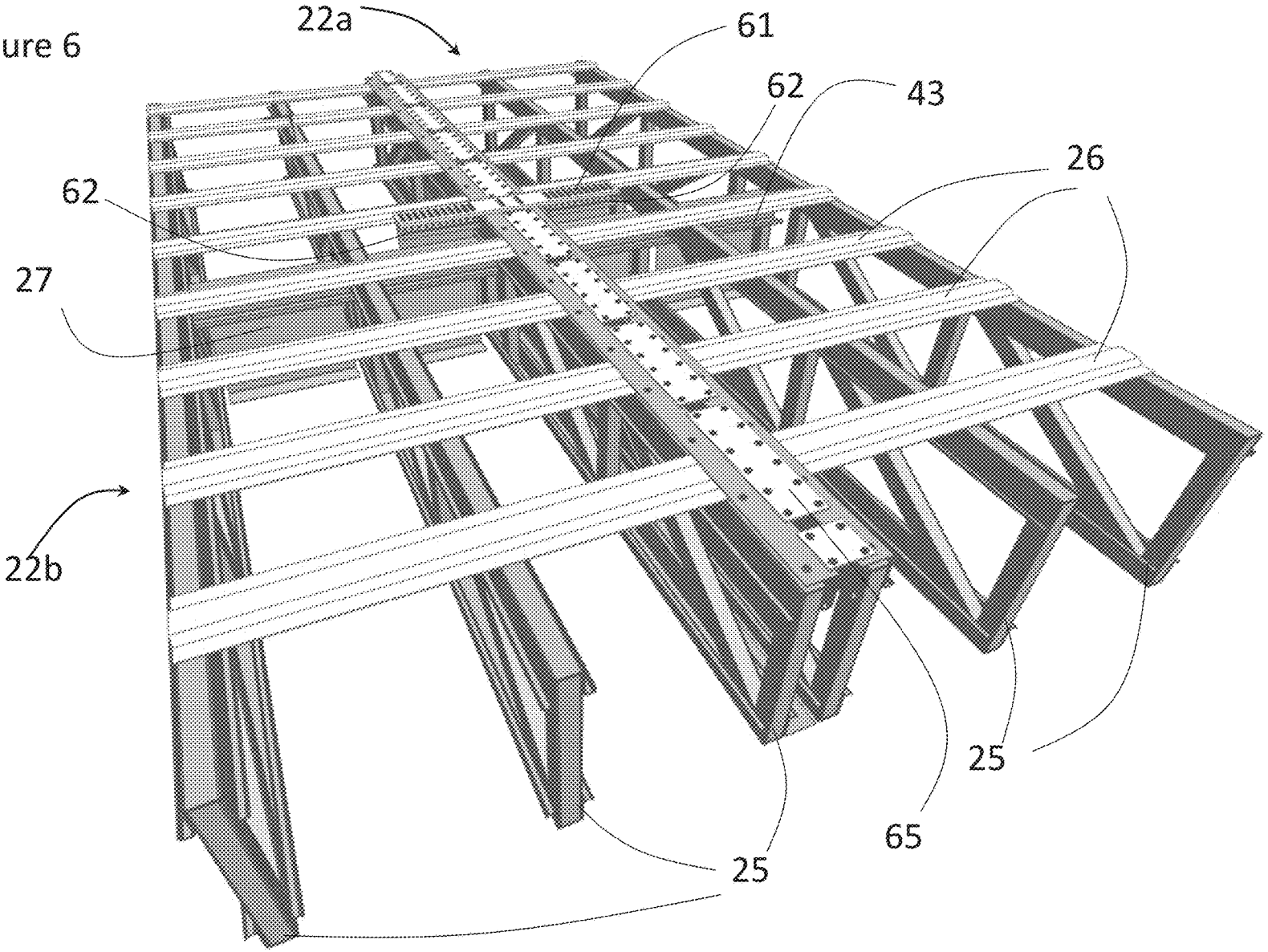
FIG. 6 is an isometric view of a pair of building components of the exemplary prefabricated modular building system of FIG. 1 with the wall coverings removed.
Figure 7:
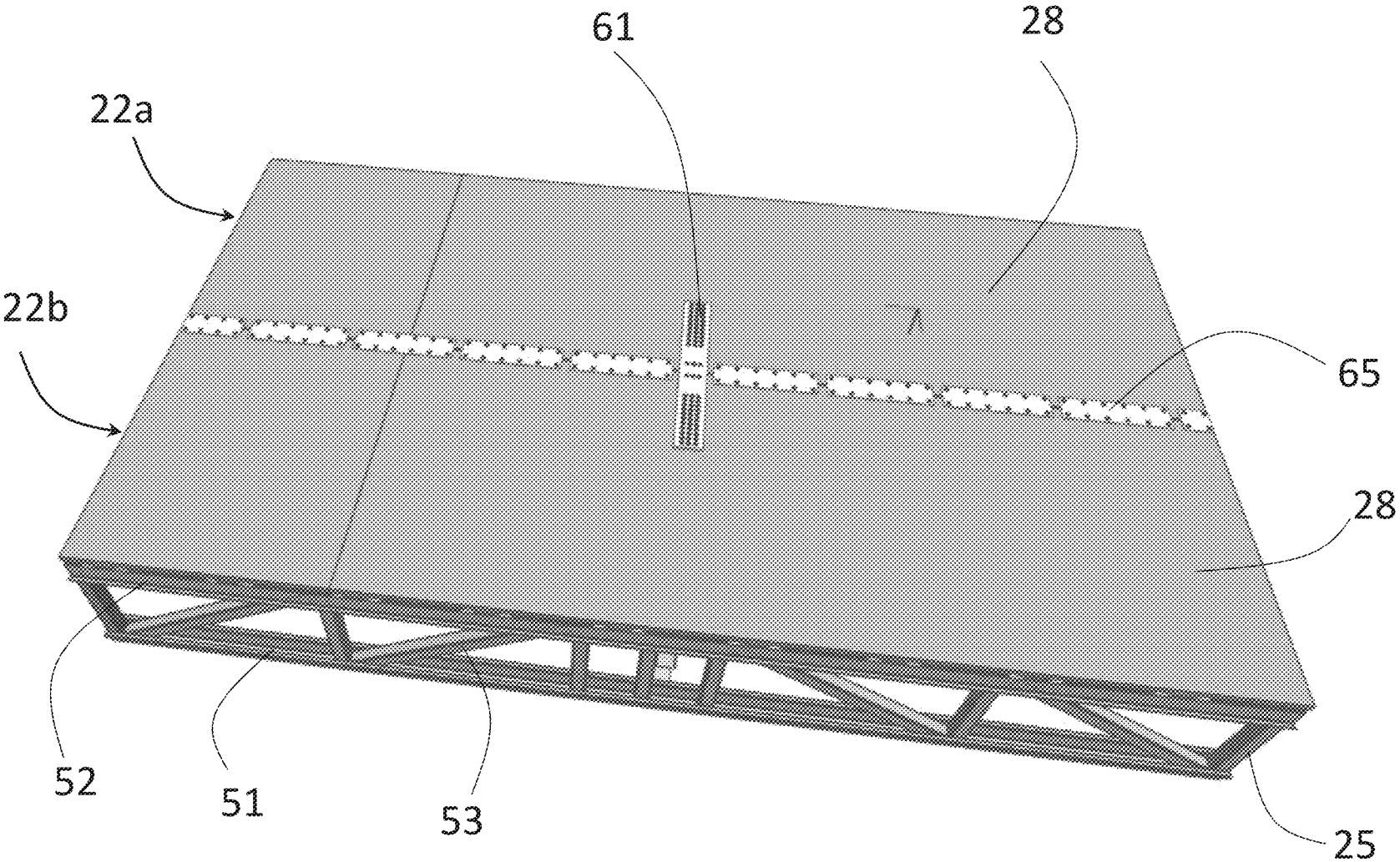
FIG. 7 is an isometric view of a pair of building components of the exemplary prefabricated modular building system of FIG. 1.
Figure 8:
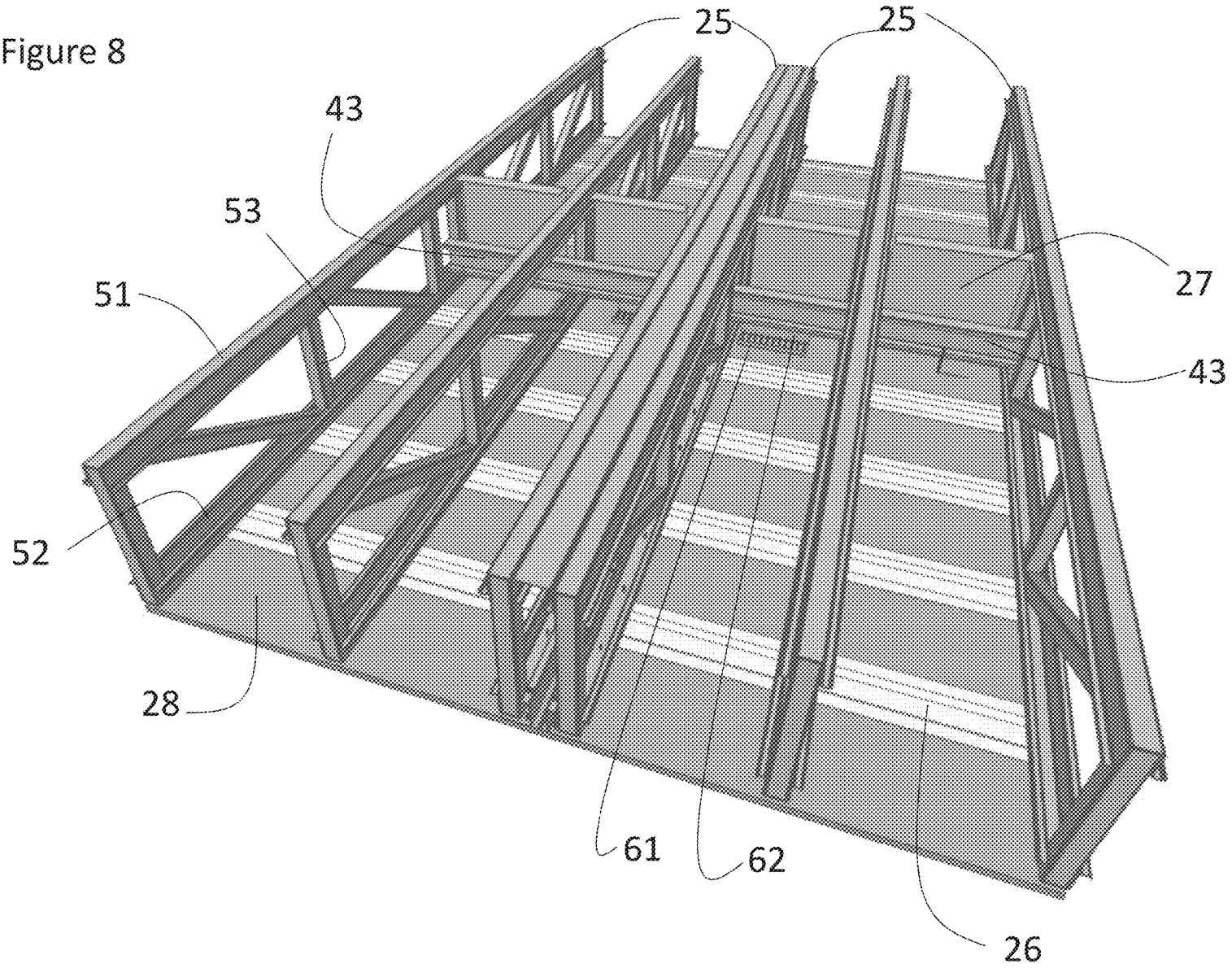
FIG. 8 is an isometric view of a pair of building components of the exemplary prefabricated modular building system of FIG. 1.

A panel connector 61 may be provided for connecting a perpendicular lateral force collector 43 on a first ceiling/ floor component 22*a* to another perpendicular lateral force collector 43 on a second ceiling/floor component 22*b* (See FIG. 5). Since the ceiling/floor component 22*a* may be a sealed unit with the inside covering 28 and the outside covering 29 already in place, an extender 62 may be provided for extending the perpendicular lateral force collector 43 down to a level with the inside covering 28, whereby the panel connector 61 may be mounted on the outside of the inside covering 28 (see FIG. 6). The panel connector 61 may be an elongated flat plate comprised of a suitably strong material, e.g. steel, extending two to six feet in length, and fastened to the extender 62 using a suitable fastener, e.g. bolts. Component connectors 65 may be provided for connecting adjacent building components, e.g. ceiling/floor components 22*a* and 22*b*, together. The component connector 65 may comprise an elongated flat plate fixed to the upper chords 51 and/or the bottom chords 52 of adjacent support members 25, e.g. trusses, utilizing suitable fastening members, e.g. bolts.

The internal lateral bridging 27 may extend between adjacent support members 25, and from the perpendicular lateral force collector 43 to the outer cover 29, thereby enabling any lateral forces generated in the room above the ceiling/floor component 22*a* or 22*b* to be transferred to the lateral force collector 43.

Figure 9:
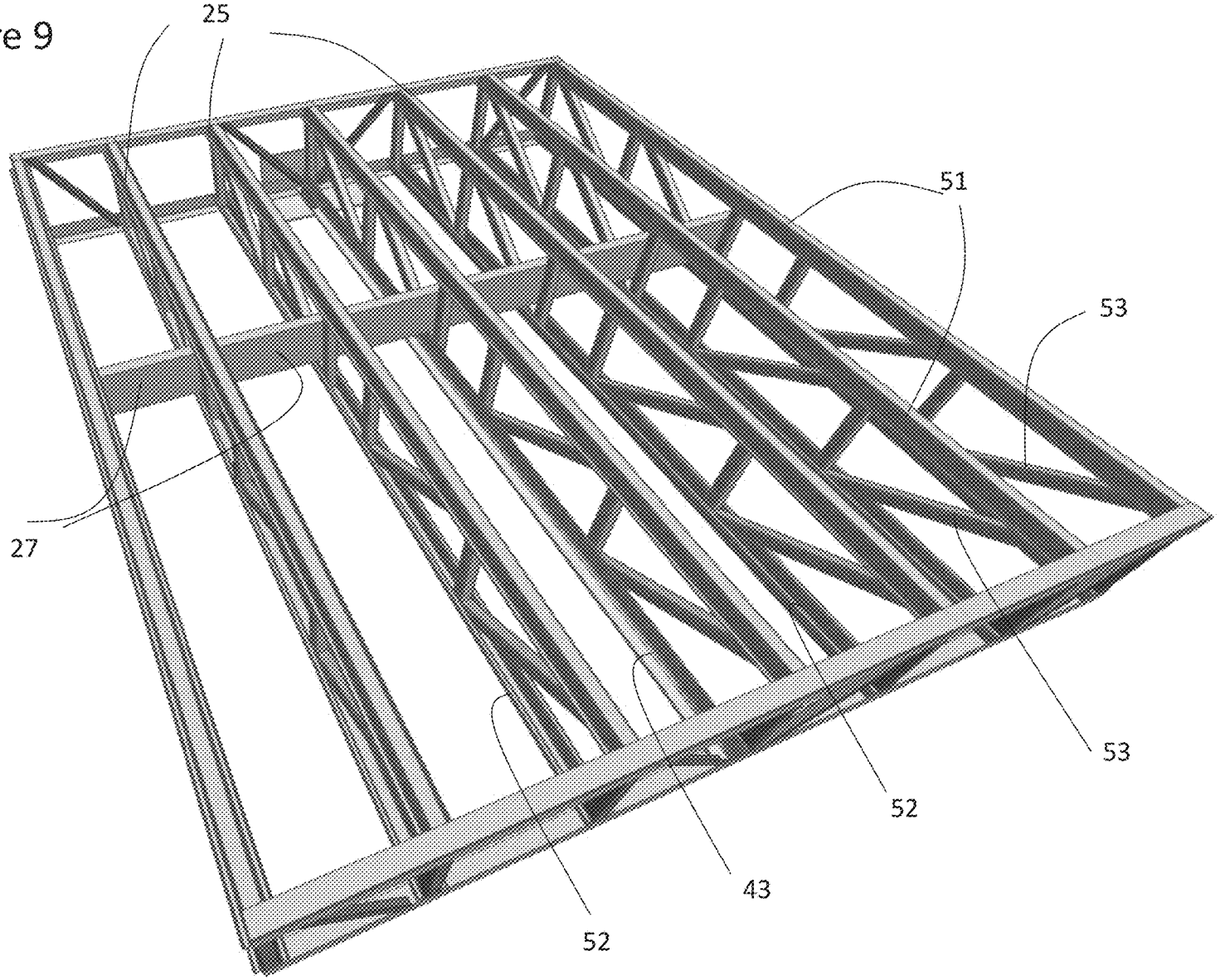
FIG. 9 is an isometric view of another building component of the exemplary prefabricated modular building system of FIG. 1 with the wall coverings removed.
Figure 10:
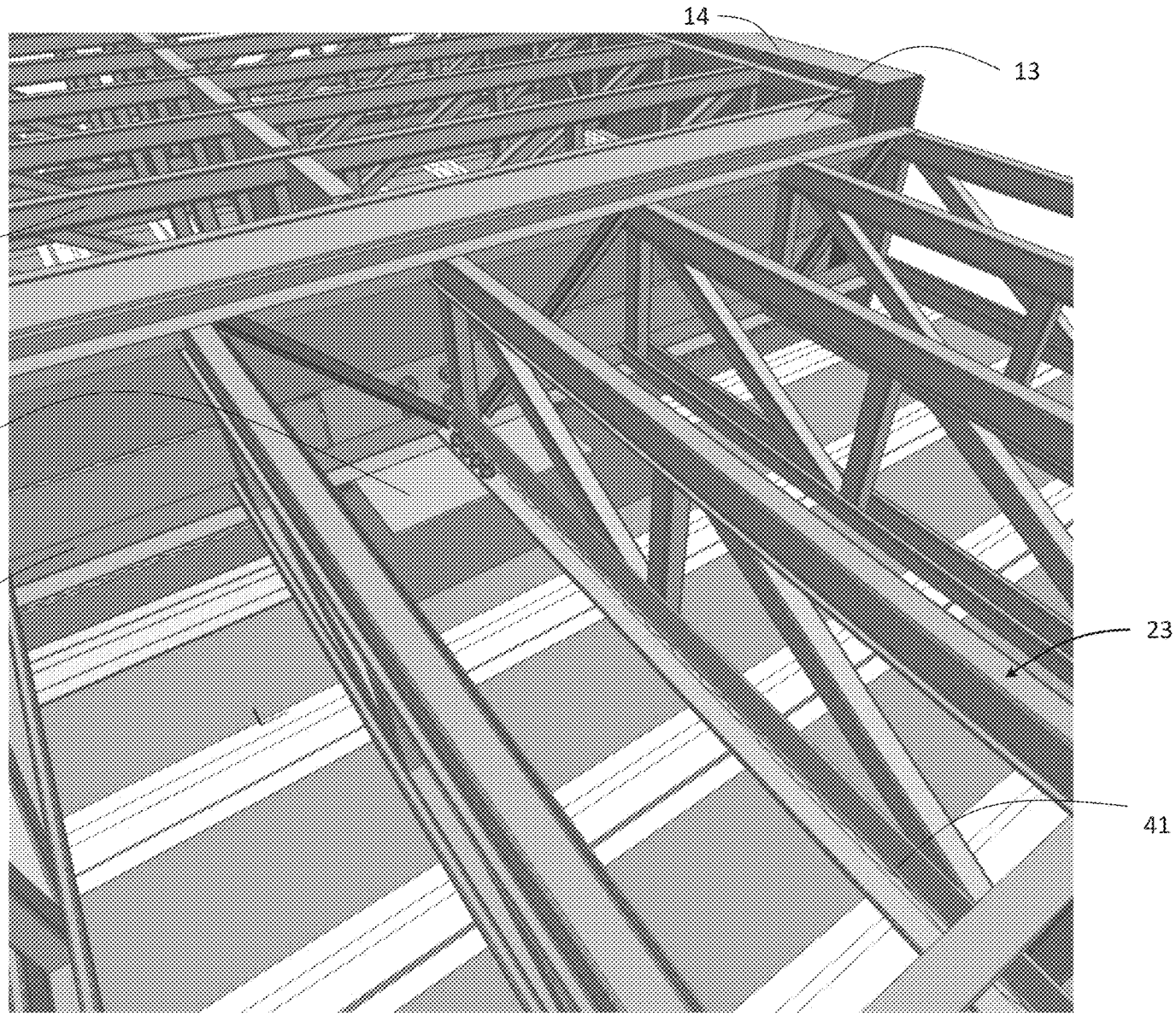
FIG. 10 is an enlarged isometric view of a wall connector of the exemplary prefabricated modular building system of FIG. 1 with the wall coverings removed.
Figure 11:
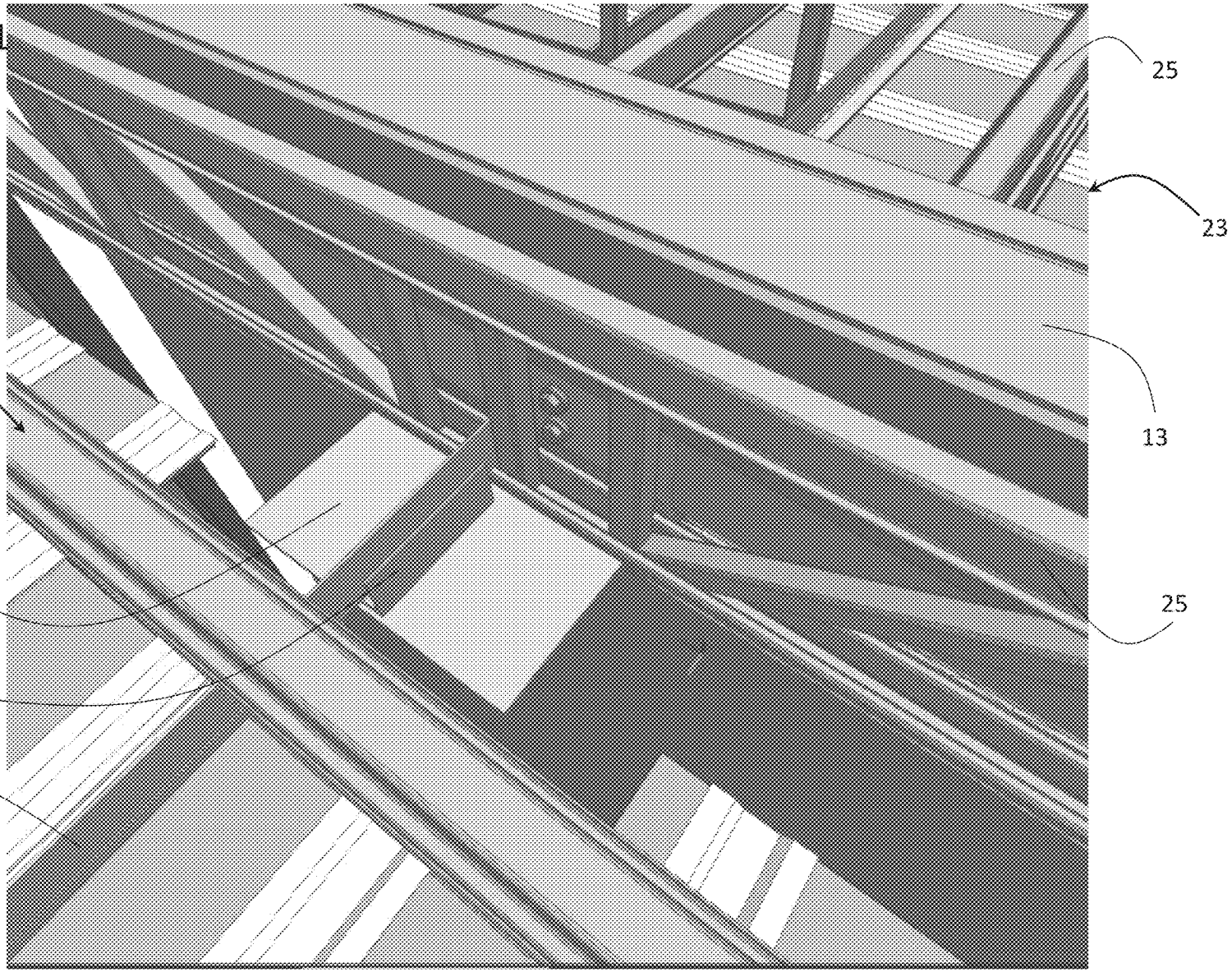
FIG. 11 is an enlarged isometric view of the wall connector of the exemplary prefabricated modular building system of FIG. 1 with the wall coverings removed.

With reference to FIG. 9, the ceiling/floor component 23 may include a plurality of support members 25, e.g. beams, joists or trusses, fixed together with the top lateral bridging (not shown) and/or the internal lateral bridging 27 extending therebetween. In the illustrated example, each support member 25 comprises a ceiling truss including a top chord 51, a bottom chord 52 and a web 53 extending therebetween. The parallel lateral force collector 41 extends along, e.g. parallel to, the support members 25, mounted on a the bottom chord 52. The parallel lateral force collector 41 may comprise any suitable structural element for transferring lateral forces, e.g. a steel L-beam or C-beam.

Since the parallel lateral force collector 41 already extends along the lower portion, e.g. chord 52, of the support members 25, e.g. the trusses, an extender 62 is not necessary. Accordingly, the parallel lateral force collectors 41 of adjacent ceiling/floor components 23 may be connected together with a panel connector 61, as defined above.

When a ceiling/floor component 22*a* or 22*b* with a perpendicular lateral force collector 43 or a ceiling/floor component 23 with a parallel lateral force collector 41 meets a wall, a wall lateral force connector 42 may be provided for transferring the lateral forces from one lateral force collector through the wall to another lateral force collector. For example, with reference to FIGS. 10-13, the wall lateral force connector 42 includes a first wall mounting member, e.g. a first shelf 71, mounted on one side of the wall 13 for receiving an end of the parallel lateral force collector 41 from the ceiling/floor component 23. The end of the parallel lateral force collector 41 may be fixed to the first shelf 71 using a suitable fastener, e.g. bolts. The wall lateral force connector 42 may also include a second wall mounting member, e.g. a second shelf 72, mounted on an opposite side of the wall 13 for receiving an end of another lateral force collector, e.g. the perpendicular lateral force collector 43 from the ceiling/floor component 22*b*. The end of the perpendicular lateral force collector 43 may be fixed to the second shelf 72 via an extender 62 using a suitable fastener, e.g. bolts.

Figure 12:
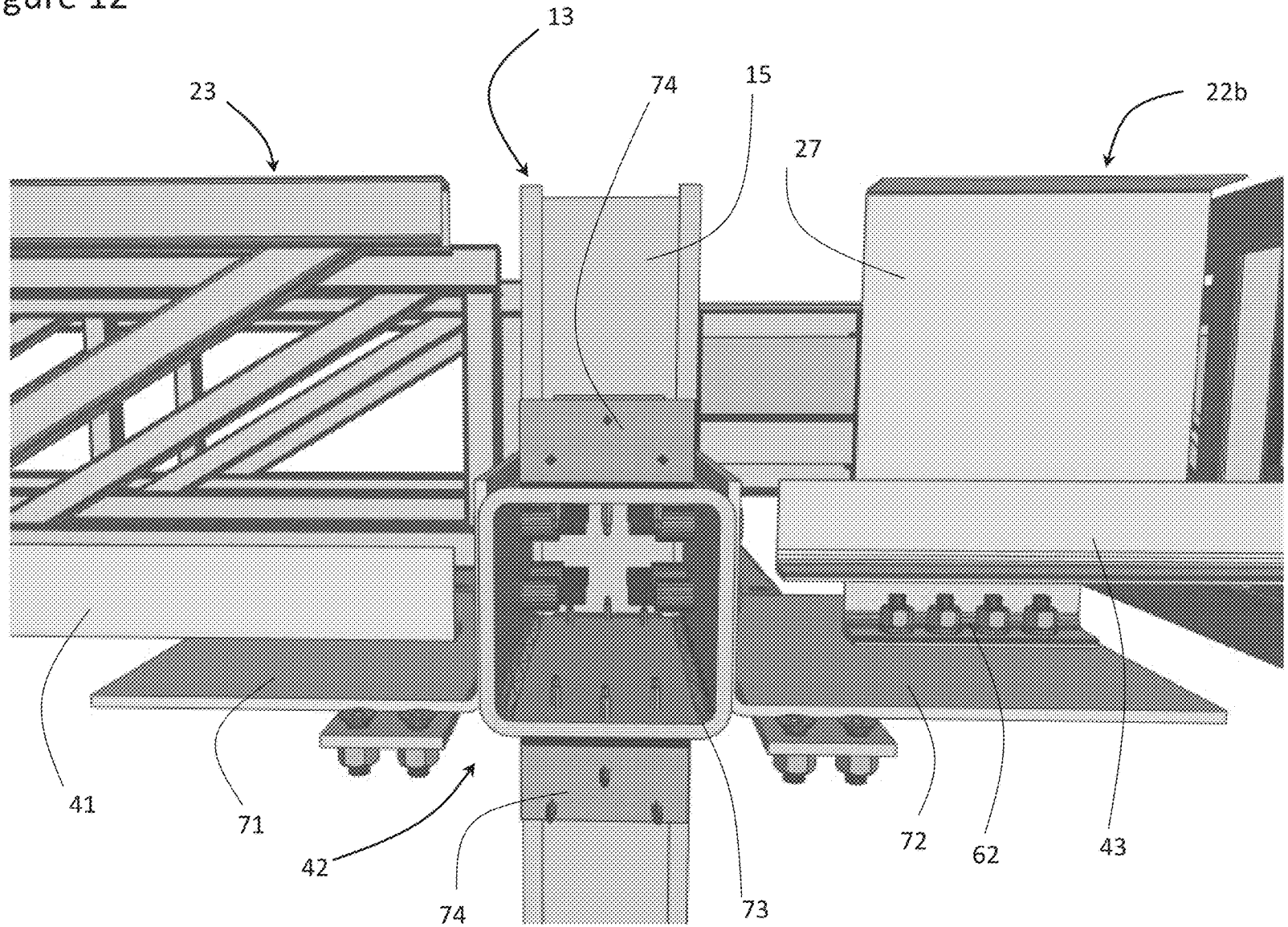
FIG. 12 is a side view of the wall connector of FIG. 10 connected to a second building component.
Figure 13:
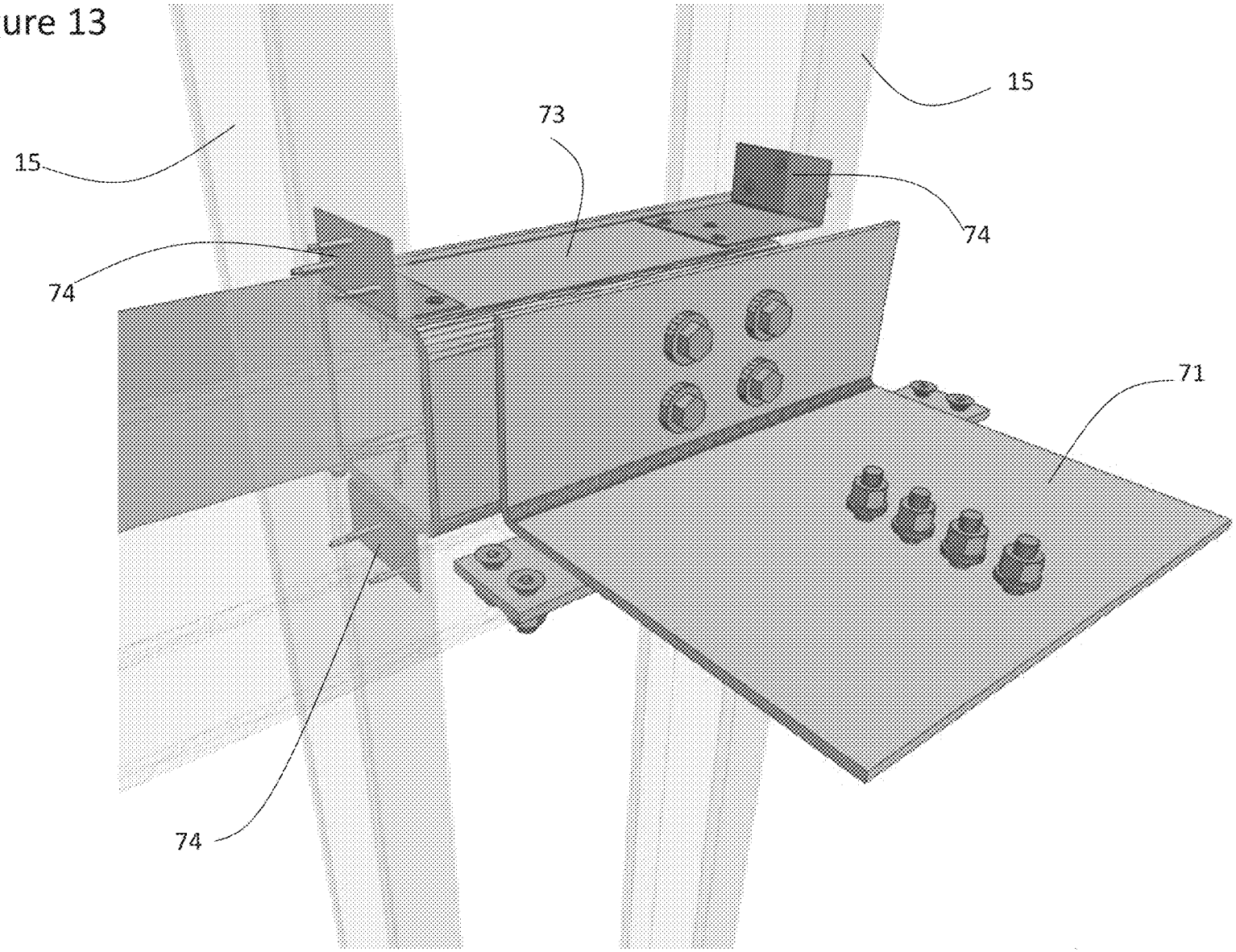
FIG. 13 is an isometric view of the wall connector of FIG. 10.
Figure 14A:
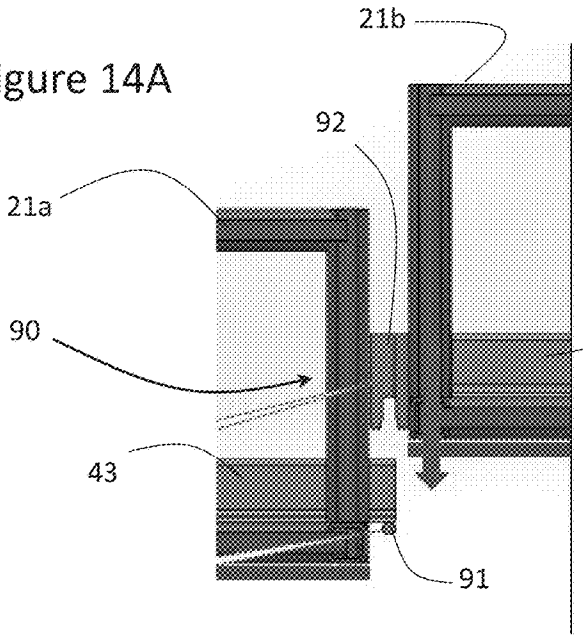
FIGS. 14A-14D are side views of a mating panel connectors of the exemplary prefabricated modular building system of FIG. 1.
Figure 14B:
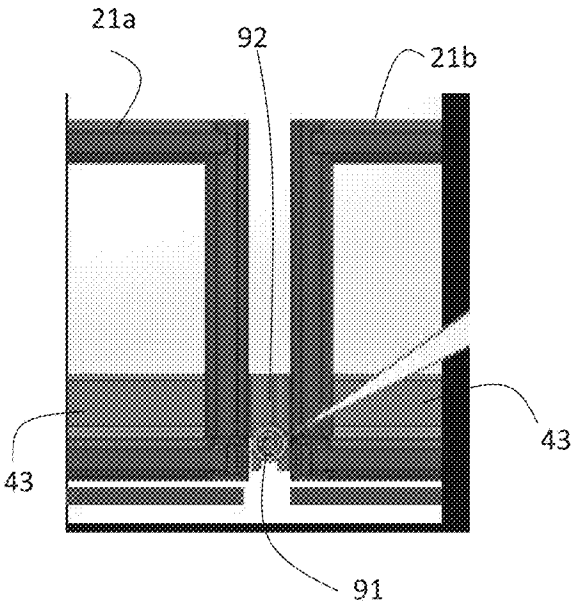
Figure 14C:
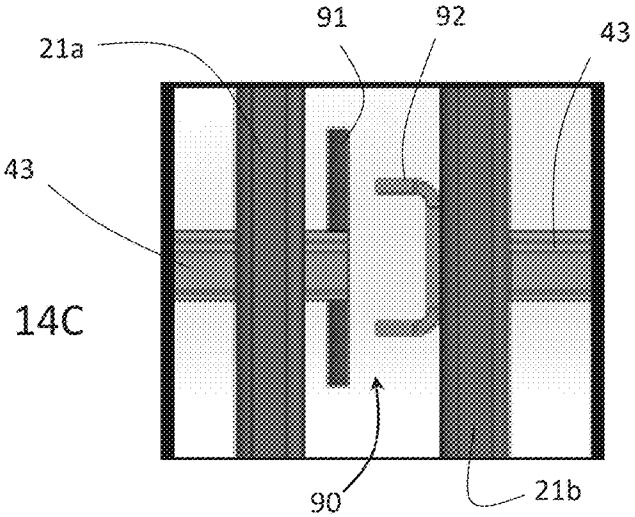
Figure 14D:
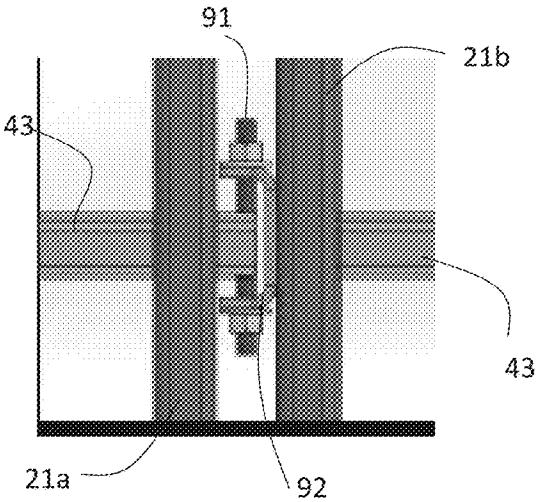

With reference to FIGS. 12 and 13, the wall lateral force connector 42 may also include a wall collector 73 mounted in the wall 13 connected to both the first shelf 71 and the second shelf 72. The wall collector 73 may be mounted between adjacent studs 15 in the wall 13 using stud brackets 74 above and below the wall collector 73 on each of the adjacent studs. The wall collector 73 may comprise a suitably strong material, e.g. steel, and may have a substantially square cross-section. The wall collector 73 may extend twelve to twenty four inches, depending on the distance between the studs 15.

Ceiling/floor components 21*a*, 21*b*, 22*a*, 22*b* and 23 may include both parallel lateral force collectors 41 and perpendicular lateral force collectors 43, since the perpendicular lateral force collectors 43 extend across the tops of the bottom chords 52, while the parallel lateral force collectors 41 extend along the bottom chords 52. Accordingly, lateral force collector systems with a plurality of shear wall components 31 may be arranged in perpendicular directions for the modular building system 1.

With reference to FIGS. 14A-14D and 15, an alternative system for connecting to perpendicular lateral force collectors 43 from two adjacent ceiling/floor components, e.g. 21*a* and 21*b*, without using an extender 62 includes a mating panel connector 90. The mating panel connector 90 includes a first mating connector 91 on an end of a first perpendicular lateral force collector 43 of the first ceiling/floor component 21*a*, and a second mating connector 92 on an end of a second lateral force collector 43 of the second ceiling/floor component 21*b* configured to interconnect with the first mating connector 91. The first lateral force collector 43 extends out one side of the first ceiling/floor component, e.g. 21*a*, and the second lateral force collector 43 extends out one side of the second ceiling/floor component 21*b*. In the illustrated embodiment, the first mating connector 91 comprises a cylindrical rod extending perpendicular to the first lateral force collector 43, and the second mating connector 92 comprises a pair of parallel arms extending from the end of the second lateral force collector 43, each of the pair of parallel arms including a groove configured to receive portions of the cylindrical rod. The cylindrical rod may be threaded on each end for receiving a threaded fastener for locking the cylindrical rod in the grooves.

Figure 15:
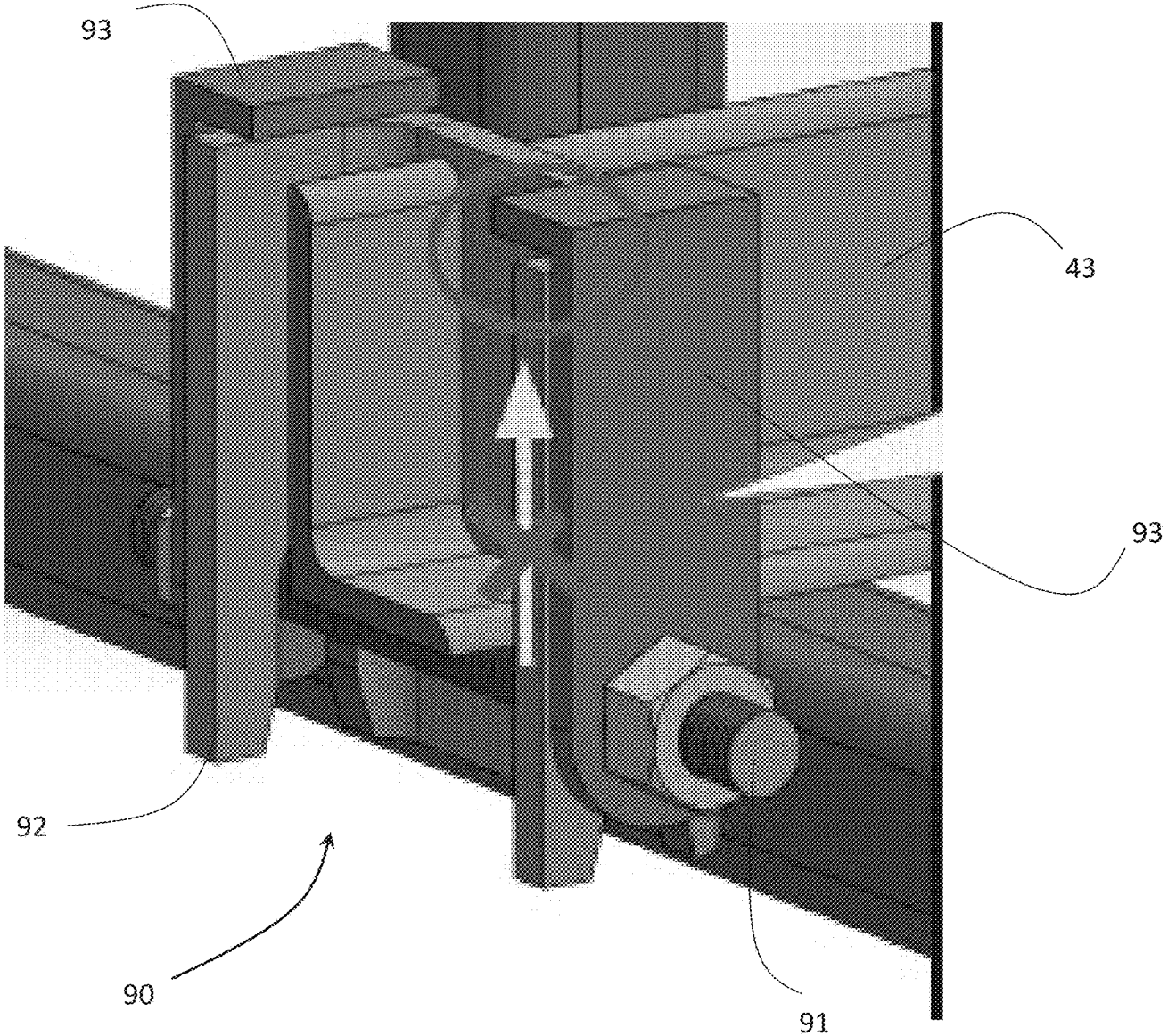
FIG. 15 is an enlarged isometric view of the mating panel connectors of FIGS. 14A-14D including a lock washer.

With reference to FIG. 15, the mating panel connector 90 may also include a lock washer 93 comprising a first end configured to be mounted on the cylindrical rod of the first mating connector 91, and a second end configured to extend over the top of the arms of the second mating connector 92, thereby preventing the arms of the second mating connector 92 from disengaging from the cylindrical rod of the first mating connector 91.

Figure 16:
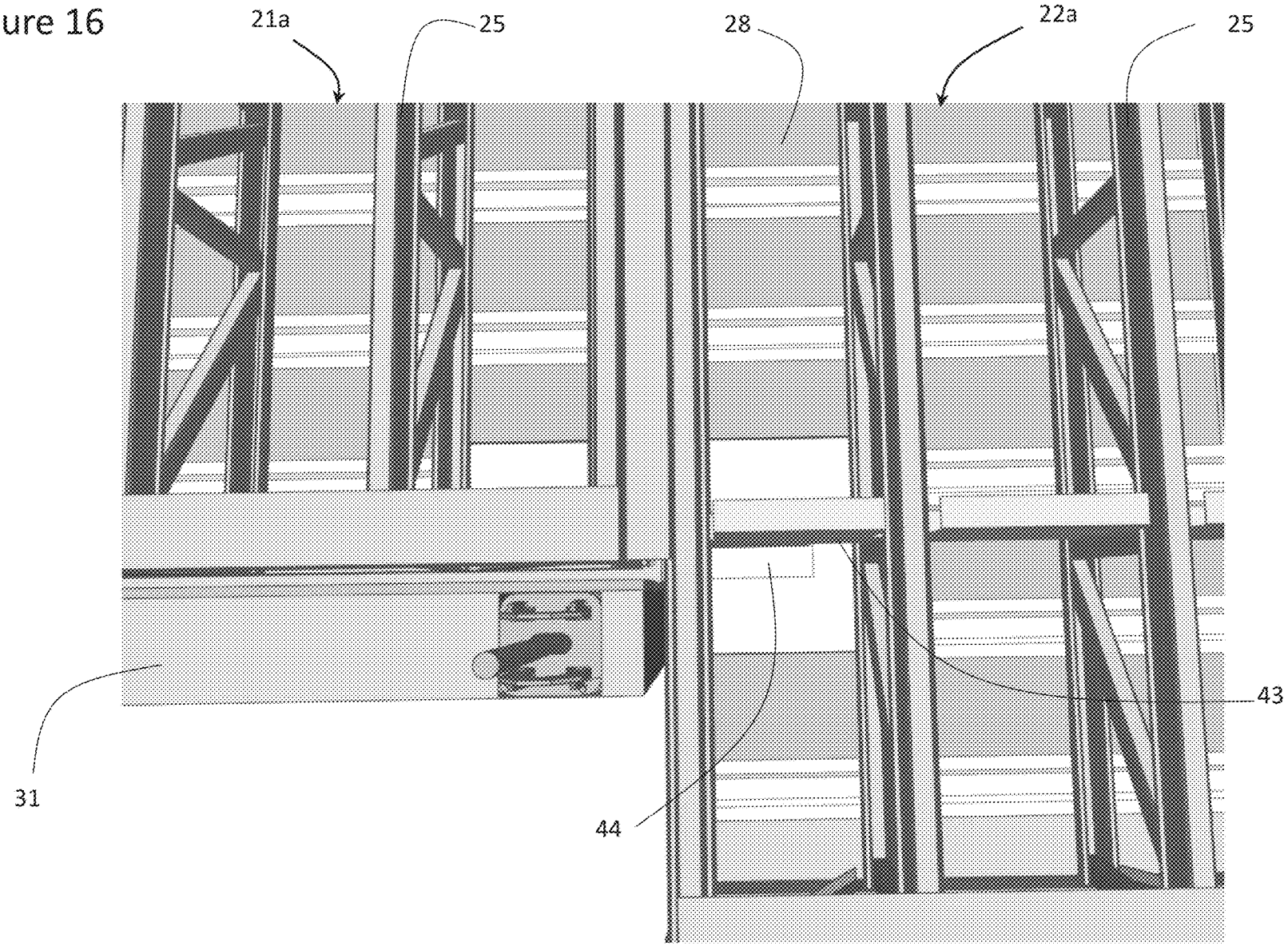
FIG. 16 is a top view of a building component of the exemplary prefabricated modular building system of FIG. 1 connected to a shear wall component with the wall coverings removed.
Figure 17:
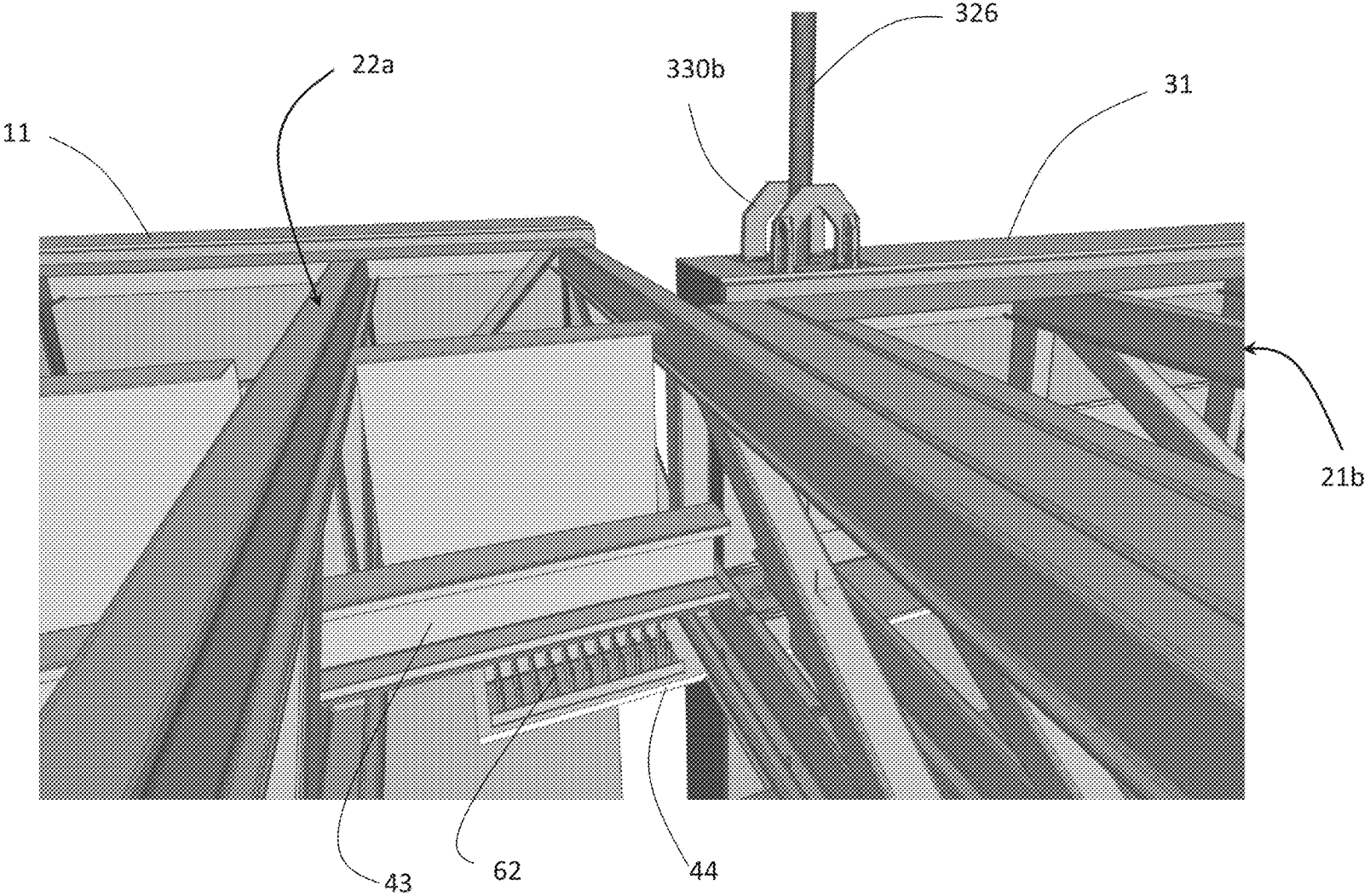
FIG. 17 is an enlarged isometric view of the building component of FIG. 16.

With reference to FIGS. 16 and 17, a wall lateral force collector 44 may be used to connect the lateral force collector 43 of the ceiling/floor component 22*a* to the shear wall component 31. An extender 62 may be used to lower the perpendicular later force collector 43 down to the level of the inner cover 28, as in hereinbefore described, to connect with the wall lateral force collector 44.

Figure 18:
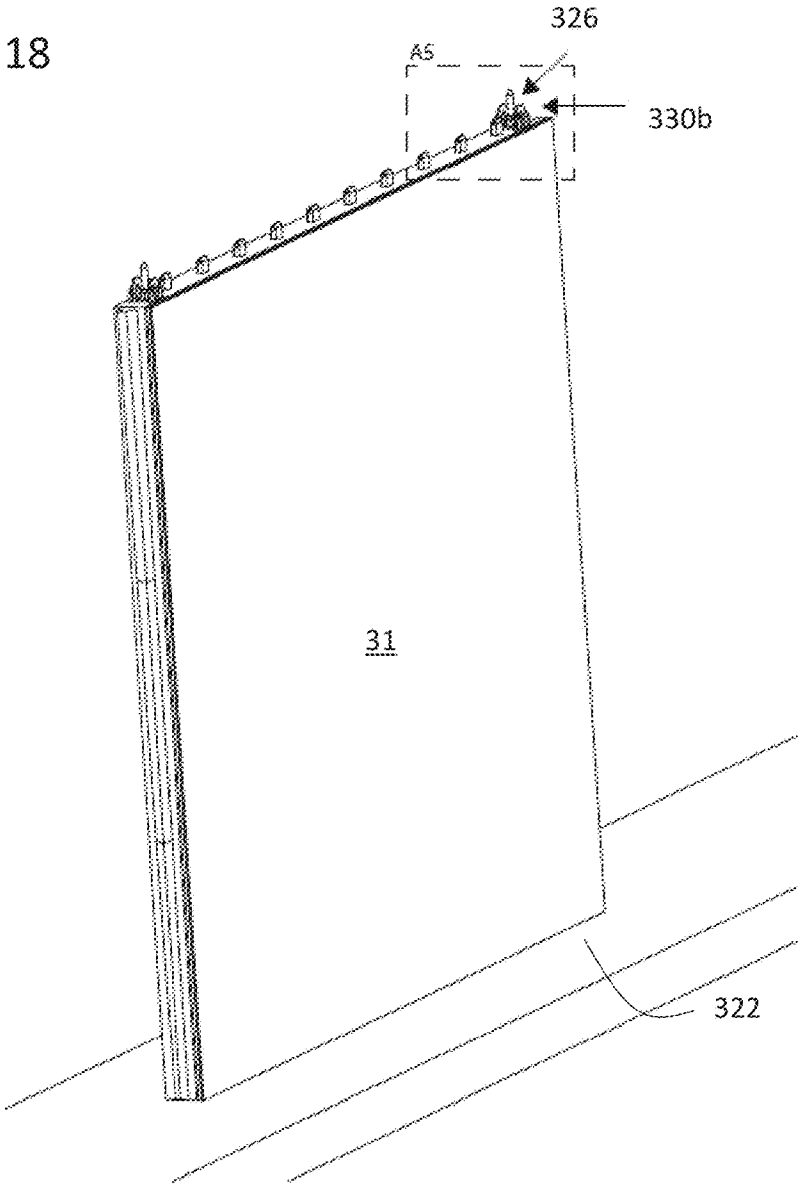
FIG. 18 is an isometric view of a prefabricated shear wall component of the exemplary prefabricated modular building system of FIG. 1.
Figure 19:
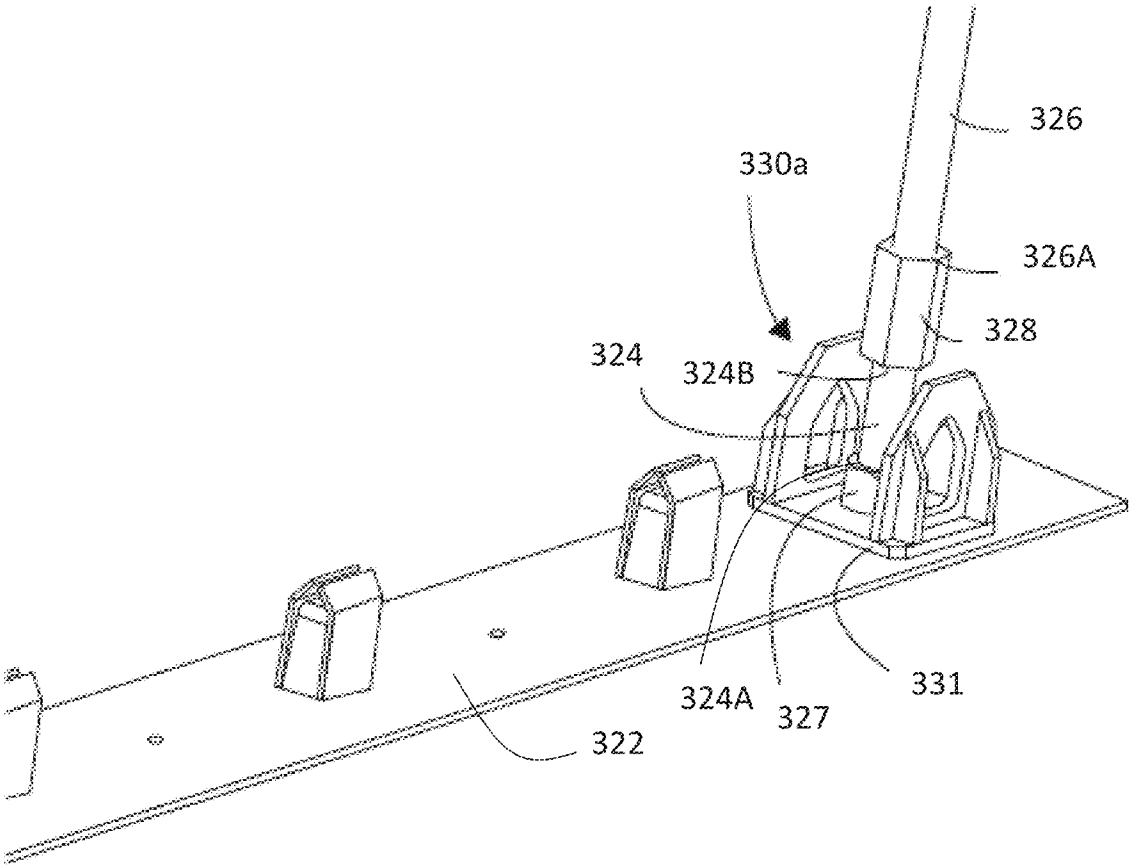
FIG. 19 is an enlarged isometric view of a bottom portion of the prefabricated shear wall component of FIG. 18.
Figure 20:
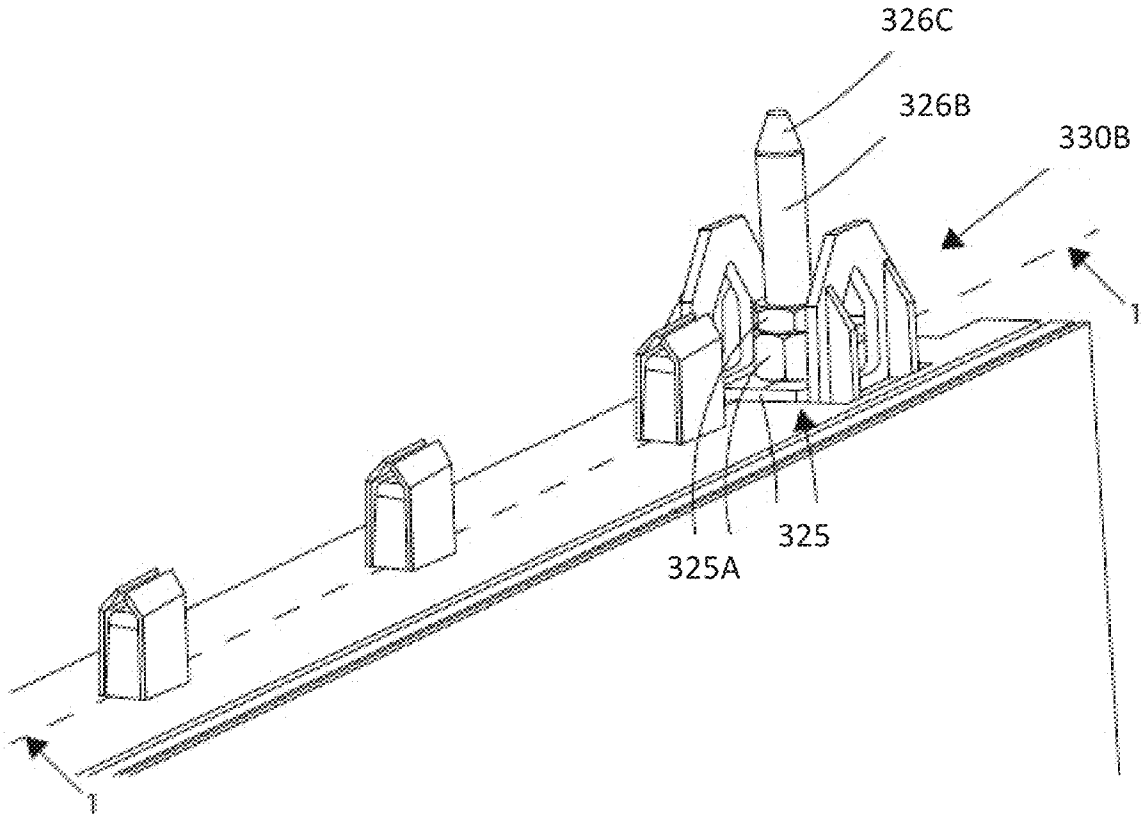
FIG. 20 is an enlarged isometric view of a top portion of the prefabricated shear wall component of FIG. 18.

With reference to FIGS. 18-20 a prefabricated shear wall component 31 may include a base support element 322, and a first anchoring element 324 with a first end 324A of the anchoring element 324 connected to the base support element 322. A second end 324B of the first anchoring element 324 is coupled to a first end 326A of a second anchoring element 326 via a coupler 328. The coupler 328 may be a coupler nut having two threaded portions at two ends each configured to be coupled to the first and the second anchoring elements 324 and 326 respectively.

As seen in FIG. 21, the shear wall component 31 further includes a first alignment element 330A connected to the base support element 322 such that the first anchoring element 324 passes through a base portion 331 of the first alignment element 330A and is locked at the first alignment element 330A by a lock nut 327. The first alignment element 330A is configured to be received into and align a bottom opening of the prefabricated shear wall component 31 while being lowered into position on the base support element 322.

The prefabricated shear wall component 31 may be lowered onto the base support element 322 while receiving the first anchoring element 324, the first end 326A of the second anchoring element 326, and the coupler 328 within an anchor pathway through a bottom opening of the shear wall component 31. As best seen in FIGS. 22 and 2E, a second end 326B of the second anchoring element 326 protrudes from a top opening of the anchor pathway.

The shear wall component 31 may include a second alignment element 330B positioned at the top opening of the anchor pathway, such that a through-opening formed in the base portion 331 of the first alignment element 330A is aligned with the top opening. The second end 326B of the second anchoring element 326 passes through the through-opening and is locked at the top opening by a locking element 325. The locking element 325 may include a washer plate placed over a base portion of the second alignment element 330B, a lock nut and a jam nut 325A. The second end 326B of the second anchoring element 326 may constitute a first anchoring element for another top prefabricated shear wall component 31 to be received on the top of the prefabricated shear wall component 31, and the other alignment element 330 positioned at the top opening may be configured to align the bottom opening of the anchor pathway of the other top prefabricated shear wall component 31. The second end 326B of the second anchoring element 326 may include a guiding tip 326C removably connected thereto and configured to assist the guiding of the second end 326B through the anchor pathway, the top opening, and the through-opening.

The foregoing description of one or more example embodiments has been presented for the purposes of illustration and description. It is not intended to be exhaustive or to limit the invention to the precise form disclosed. Many modifications and variations are possible in light of the above teaching. It is intended that the scope of the disclosure be limited not by this detailed description.

The invention claimed is:

1. A modular construction system comprising:

a first prefabricated building component including:

a first plurality of support members extending parallel to each other in a first direction, the first plurality of support members comprising a first plurality of trusses, wherein each of the first plurality of trusses includes a first top chord, a first bottom chord, and first web members extending therebetween; and a first lateral force collector configured to transfer lateral forces, wherein the first lateral force collector extends parallel to the first plurality of support members and comprises one of the first bottom chords;

a second prefabricated building component including:

a second plurality of support members extending parallel to each other in a second direction; and a second lateral force collector configured to transfer the lateral forces; and a connector extending between the first lateral force collector and the second lateral force collector configured to transfer the lateral forces therebetween.

2. The modular construction system according to claim 1, wherein the first lateral force collector and the second lateral force collector are colinear.

3. The modular construction system according to claim 1, wherein the first lateral force collector is mounted on top of the first bottom chords of the first plurality of trusses.

4. The modular construction system according to claim 3, wherein the first lateral force collector includes a first extender extending down to a level even with a bottom of the first bottom chord.

5. The modular construction system according to claim 3, wherein each of the second plurality of trusses including a second top chord, a second bottom chord, and second web members extending therebetween; and wherein the second lateral force collector extends perpendicular to the second plurality of trusses, and is mounted on top of the second bottom chords thereof.

6. The modular construction system according to claim 5, wherein the second lateral force collector includes a second extender extending down to the level even with a bottom of the second bottom chord.

7. The modular construction system according to claim 6, wherein the first lateral force collector is mounted on top of the first bottom chords of the first plurality of trusses; and wherein the connector extends between the first extender and the second extender.

8. The modular construction system according to claim 7, wherein the connector is configured to connect the first extender and the second extender along bottom surfaces of the first and second extenders.

9. The modular construction system according to claim 5, wherein the first lateral force collector extends out one side of the first prefabricated building component; and wherein the second lateral force collector extends out one side of the second prefabricated building component; and wherein the connector includes a first mating connector on the first lateral force collector, and a second mating connector on the second lateral force collector configured to interconnect with the first mating connector.

10. The modular construction system according to claim 1, wherein the second lateral force collector extends parallel to the second plurality of support members.

11. The modular construction system according to claim 10, wherein the first lateral force collector and the second lateral force collector extend along parallel axes; and wherein the second plurality of support members comprises a second plurality of trusses, wherein each of the second plurality of trusses including a second top chord, a second bottom chord, and second web members extending therebetween; and wherein the second lateral force collector comprises one of the second bottom chords.

12. The modular construction system according to claim 1, further comprising a first wall;

wherein the connector comprises:

a first wall mounting member configured to mount on a first side of the first wall and configured to receive a first end of the first lateral force collector;

a second wall mounting member configured to mount on a second side of the first wall configured to be to receive a first end of the second lateral force collector; and a wall collector configured to mount in the first wall and connected to the first wall mounting member and the second wall mounting member.

13. The modular construction system according to claim 12, further comprising a second wall; and a first L-bracket mounted on a first side of the second wall configured to receive ends of the first plurality of support members or one of the first plurality of support members.

14. The modular construction system according to claim 1, further comprising a first bottom layer on the first plurality of support members, and a first top layer mounted on the first plurality of support members.

15. The modular construction system according to claim 14, wherein the first bottom layer comprises drywall.

16. The modular construction system according to claim 14, wherein the first top layer comprises concrete.

17. The modular construction system according to claim 1, further comprising a second bottom layer on the second plurality of support members, and a second top layer of mounted on the second plurality of support members.

18. The modular construction system according to claim 17, wherein the second bottom layer comprises drywall.

19. The modular construction system according to claim 17, wherein the second top layer comprises concrete.

20. The modular construction system according to claim 17, further comprising first bridging members extending between adjacent ones of the first plurality of support members, the first lateral force collector and the first top layer.

21. The modular construction system according claim 1, wherein the first prefabricated building component or the second prefabricated building component comprises a shear wall.

22. A modular construction system comprising:

a first prefabricated building component including:

a first plurality of support members extending parallel to each other in a first direction; and a first lateral force collector extending out one side of the first prefabricated building component and configured to transfer lateral forces; and a connector connected to the first lateral force collector and configured to connect the first lateral force collector to a second lateral force collector for transferring the lateral forces therebetween, wherein the connector includes a first mating connector on the first lateral force collector configured to mate with a second mating connector on the second lateral force collector.

23. The modular construction system according to claim 22, wherein the first plurality of support members comprises a first plurality of trusses, wherein each of the first plurality of trusses including a first top chord, a first bottom chord, and first web members extending therebetween; and wherein the first lateral force collector extends perpendicular to the first plurality of trusses, and is mounted on top of the first bottom chords of the first plurality of trusses.

24. The modular construction system according to claim 23, wherein the first lateral force collector includes a first extender extending down to a level even with a bottom of the first bottom chord.

25. The modular construction system according to claim 24, wherein the connector is configured to connect the first extender to a second extender in an adjacent floor component along bottom surfaces of the first and second extenders.

26. The modular construction system according to claim 22, wherein the first plurality of support members comprises a first plurality of trusses, wherein each of the first plurality of trusses including a first top chord, a first bottom chord, and first web members extending therebetween; and wherein the first lateral force collector extends parallel to the first plurality of trusses.

27. The modular construction system according to claim 26, wherein the first lateral force collector comprises one of the first bottom chords.

28. The modular construction system according to claim 22, further comprising a first wall;

wherein the connector comprises:

a first wall mounting member configured to mount on a first side of the first wall and configured to receive a first end of the first lateral force collector;

a second wall mounting member configured to mount on a second side of the first wall configured to be to receive a first end of the second lateral force collector; and a wall collector configured to mount in the first wall and connected to the first wall mounting member and the second wall mounting member.

29. The modular construction system according to claim 28, further comprising a first L-bracket for mounting on a first side of a second wall configured to receive ends of the first plurality of support members.

30. The modular construction system according to claim 22, further comprising a first bottom layer on the first plurality of support members, and a first top layer mounted on the first plurality of support members.

31. The modular construction system according to claim 30, wherein the first bottom layer comprises drywall.

32. The modular construction system according to claim 30, wherein the first top layer comprises one or more of concrete, insulation, RPG, PV cells.

33. The modular construction system according claim 22, further comprising a shear wall connected to the first lateral force collector.

* * * * *